US005599264A

United States Patent [19]

Hashimoto et al.

[11] Patent Number: 5,599,264

[45] Date of Patent: Feb. 4, 1997

[54] ROLLER WIDTH ADJUSTING DEVICE FOR A DIVIDED TYPE MOLDING ROLLER

[75] Inventors: Yuji Hashimoto; Takaaki Toyooka; Susumu Itatani; Tsutomu Ide, all of Chiba, Japan

[73] Assignee: Kawasaki Steel Corporation, Hyogo-ken, Japan

[21] Appl. No.: 415,470

[22] Filed: Apr. 3, 1995

Related U.S. Application Data

[63] Continuation of Ser. No. 386,911, Feb. 8, 1995, abandoned.

[51] Int. Cl.[6] ..... B21D 5/12

[52] U.S. Cl. ..... 492/39; 72/247

[58] Field of Search ..... 492/39, 42; 72/247

[56] References Cited

U.S. PATENT DOCUMENTS

| | | | |
|---|---|---|---|
| 5,434 | 2/1848 | Pratt | 492/39 |
| 36,237 | 8/1862 | Read | 492/39 |
| 2,049,842 | 4/1934 | Kling | 72/247 |
| 2,178,754 | 2/1939 | Jacobson | 492/39 |
| 2,415,578 | 2/1947 | Courtney | 492/39 |
| 5,031,435 | 7/1991 | Seto et al. | 72/247 |
| 5,060,498 | 10/1991 | Seto et al. | 72/247 |
| 5,327,762 | 7/1994 | Nagamine et al. | 72/247 |

FOREIGN PATENT DOCUMENTS

| | | | |
|---|---|---|---|
| 57-28627 | 2/1982 | Japan . | |
| 57-209722 | 12/1982 | Japan . | |
| 3-138023 | 6/1991 | Japan . | |
| 884753 | 11/1981 | U.S.S.R. | 492/39 |
| 22170 | 1/1892 | United Kingdom | 492/39 |
| 10043 | 9/1906 | United Kingdom | 492/39 |
| 738493 | 10/1955 | United Kingdom | 492/39 |
| 279023 | 12/1994 | United Kingdom | 72/247 |

*Primary Examiner*—Irene Cuda
*Assistant Examiner*—Marc W. Butler
*Attorney, Agent, or Firm*—Sterne, Kessler, Goldstein & Fox P.L.L.C.

[57] ABSTRACT

A roller width adjusting device for a divided molding roller has a hollow main shaft journalled at each end to side bearings so as to be rotatable around a rotary axis thereof. The hollow main shaft is connected at one end to a driving source for rotating the main shaft around the rotary axis. A pair of hollow cylindrical roller holders are disposed on an outer periphery of intermediate portions of the main shaft so as to be slidable along the rotary axis of the main shaft. The roller holders may be fixed in any position along the rotary axis by a holding device. A pair of divided type molding rollers are attached to the roller holders, respectively. An adjusting shaft is rotatably disposed in the hollow shaft along its rotary axis. Each end of the adjusting shaft has a screw thread with opposed screw directions. One end of the adjusting shaft has a rotatable handle. By rotating the handle in one direction the interval between divided rollers is increased thus moving the roller holders farther apart; whereas by rotating the handle in the other direction the interval is decreased thus drawing the roller holders closer together. Once in position, the divided rollers are slidably fixed by the holding device such that pipe of that particular size can be manufactured.

5 Claims, 2 Drawing Sheets

ROLLER WIDTH ADJUSTING DEVICE FOR A DIVIDED TYPE MOLDING ROLLER

CROSS-REFERENCE TO RELATED APPLICATIONS

This application is a continuation of U.S. patent application Ser. No. 08/386,911, filed Feb. 8, 1995, now abandoned in favor of this continuation application.

BACKGROUND OF THE INVENTION

1. Field of the Invention

The present invention relates to a roller width adjusting device for a divided type molding roller used in manufacturing a welded steel pipe.

2. Description of Related Art

One type of molding roller device used conventionally in a production line for continuously processing a strip into a welded pipe includes an upper roller and a lower roller. The strip is passed between the upper and lower rollers and bent in a so-called flower. However, with this type of molding roller device, each time the pipe size is changed, the molding rollers need to be changed. Therefore, it is necessary to have different size molding rollers. Moreover, changing these molding rollers is difficult and expensive.

Therefore, the recent trend is to use a divided type roller system. The divided type roller system comprises left and right divided molding rollers. An interval between the two rollers can be adjusted to change the size of the pipe that is to be produced. Examples of divided type roller systems and their associated adjusting means are discussed below.

A spiral type of adjusting means for a divided type roller system is disclosed in Japanese Patent Laid-Open Gazette No. Sho 57-28627. In particular, a molding roller comprising left and right divided rollers continuously molds a metallic strip into a desired shape. In this system, an outer shaft is fitted onto an inner shaft and both the shafts are connected to each other by keys. An internal screw thread in the divided rollers mates with an external screw thread on an outer periphery of the outer shaft. A nut rotatably mates with a groove in a side surface of the divided roller and is movable parallel to the axis of the outer shaft along a key way provided on the outer periphery of the outer shaft. An interval or distance between the divided rollers is adjusted by use of screw threads formed on the inner shaft and outer shaft. However, when the divided rollers are subjected to a large load, it is likely that the inner or outer shaft will break due to the concentration of stress on the screw threads. Furthermore, there is no backlash adjusting mechanism, which is necessary for manufacturing a pipe with a thin steel sheet because precise accuracy is needed.

In the Japanese Patent Laid-Open No. Sho 57-209722, an adjusting means is disclosed which changes the interval between divided rollers. In particular, a breakdown roller stand having an upper roller and a lower roller with an adjustable interval therebetween is used for manufacturing an electric seamed steel pipe. The upper roller and lower roller each include a pair of roller members. Between the pair of rollers is a removable spacer for setting the desired interval therebetween. A fixing means is provided for fixing the pair of roller members to each other at the desired interval. To change the divided rollers for a different size pipe requires the use of a different spacer interposed between the pair of left and right divided rollers. This requires considerable time and labor.

Furthermore, in the Japanese Patent Laid-Open Gazette No. Hei 3-138023,a roller hydraulic clamp system is used to adjust the positions of the divided rollers. In particular, left and right divided rollers are adjusted into different positions by use of threaded shafts. The divided rollers are fixed to the main shafts by use of a hydraulic clamp unit provided at the roller holders, respectively. A rotary joint is used as hydraulic supply means for the hydraulic clamp. However, with this device high speed manufacturing of pipe is difficult due to the limited life span of the oil seal. To avoid this, a cooling water distribution piping may be used to limit the heat exposure to the seal. However, this makes the roller rotation device complicated.

SUMMARY OF THE INVENTION

An object of the present invention is to provide a roller width adjusting device for a divided molding roller, which solves the above-mentioned problems of the conventional techniques.

Other and further objects, features and advantages of the invention will be apparent from the following description taken in connection with the accompanying drawings.

The present invention includes a roller width adjusting device for a divided type molding roller. The roller width adjusting device includes a hollow main shaft journalled at both ends to bearings. The hollow main shaft is connected at one end to a driving source for rotating the main shaft around a rotary axis. A pair of hollow cylindrical roller holders are disposed on an outer periphery of intermediate portions of the main shaft so as to be slidable along the rotary axis of the main shaft. The roller holders are connected to divided rollers, respectively. The roller holders may be fixed in any position along the rotary axis by a holding means.

The holding means controls contact between the roller holders and the divided rollers, and the outer periphery of the main shaft. In particular, with the use of a two-stage piston mechanism, the roller holder and divided roller are slidable along the rotary axis of the main shaft so that the interval therebetween may be adjusted when the holding means is in a disengaged position. In other words, the rollers and the main shaft are not in contact. In contrast, the when the holding means is in an engaged position, the rollers are slidably fixed to the main shaft such that the divided rollers rotate with the main shaft while the roller holders remain rotationally independent or stationary relative to the main shaft.

An adjusting shaft is rotatably disposed in the hollow main shaft along its rotary axis. Each end of the adjusting shaft has a screw thread with opposed screw directions. One end of the adjusting shaft has a rotatable handle. By rotating the handle in one direction the interval between the divided rollers is increased thus moving the roller holders and divided rollers farther apart; whereas by rotating the handle in the other direction the interval is decreased thus drawing the roller holders and divided rollers closer together.

BRIEF DESCRIPTION OF THE FIGURES

The accompanying drawings, which are incorporated in and from a part of the specification, illustrate the present invention and, together with the description, serve to explain the principles of the invention. In the drawings.

DETAILED DESCRIPTION OF PREFERRED EMBODIMENTS

Figure 1:
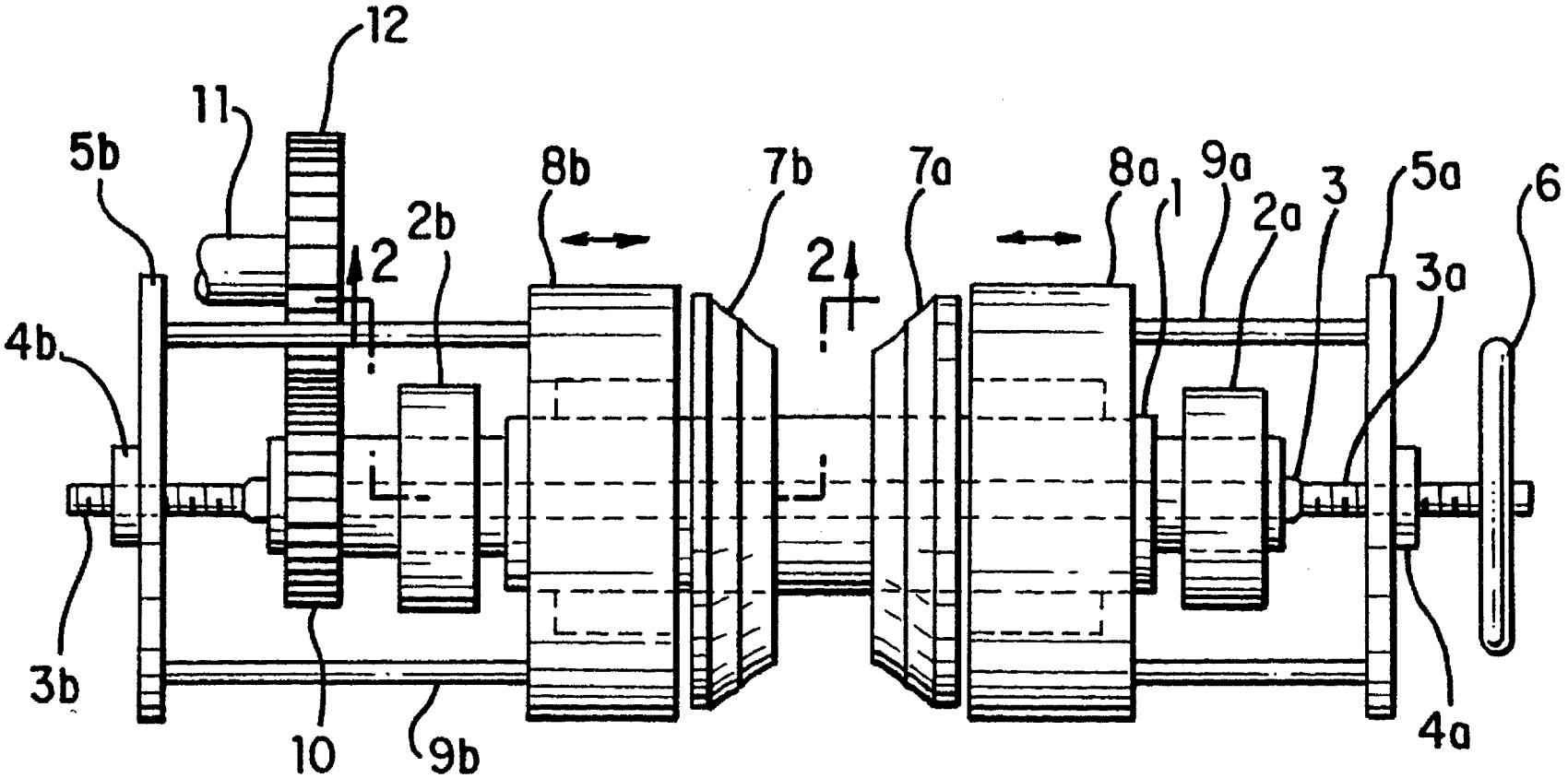
FIG. 1 is a front elevational view of the present invention.

An embodiment of the present invention will be described in accordance with the drawing figures in which similar reference numbers are used to describe similar elements.

FIG. 1 shows a front view of a roller width adjuster device for a divided type molding roller in accordance with the present invention.

As shown, a hollow main shaft 1 having a rotary axis is journalled at both ends thereof to bearings [2] 2*a* and 2*b* so as to be rotatable along a rotary axis. A gear 10 is mounted on main shaft 1 and is engageable with a gear 12 mounted on a shaft 11, which is connected with a driving device (not shown). When the driving device is driven causing shaft 11 and gear 12 to rotate, main shaft 1 is also driven (i.e., rotated).

A pair of left and right or first and second divided type rollers [7] 7*a* and 7*b* are mounted on an outer periphery of main shaft 1 at an intermediate portion thereof. A pair of left and right or first and second hollow cylindrical roller holder means 8 are also mounted on the outer periphery main shaft 1 at an intermediate portion thereof. [The left divided] Divided type roller [7] 7*b* is connected to [the left] holder means [8;] 8*b*; and [the right] divided type roller [7] 7*a* is connected to [the right] roller holder means [8] 8*a*. Roller holders means [8] 8*a* and 8*b* and divided type rollers [7] 7*a* and 7*b*, respectively, are slidable along the rotary axis of main shaft 1 as indicated by the arrows in FIG. 1.

An adjusting shaft 3 passes through the hollow interior of main shaft 1 along its rotary axis and is rotatable with respect to main shaft 1. Adjustable shaft 3 includes ends 3*a* and 3*b*. A rotatable handle 6 is mounted on end 3*a* of adjusting shaft 3 for assisting in the rotation of adjustable shaft 3. End 3*a* is provided with a screw thread having a first screw direction (e.g., clockwise). End 3*b* is provided with a screw thread having a second screw direction different from the first screw direction (e.g., counterclockwise). [A screw member 4] Screw members 4*a* and 4*b*, such as a nut, [is] are threaded onto each end 3*a* and 3*b*[.A flange 5 is],respectively. Flanges 5*a* and 5*b* are attached to each screw member 4*a* and 4*b*, respectively [4].

A pair of transmitting rods [9] 9*a* and 9*b* connect each flange [5] 5*a* and 5*b* with one of [the left and right] roller holder means [8] 8*a* and 8*b*, respectively. Accordingly, [the left] roller holder means [8, left] 8*b*, divided roller [7, left] 7*b*, transmitting rods [9, left] 9*b*, flange [5] 5*b* and [left] screw member [4] 4*b* are all connected to be slidable together along the rotary axis of main shaft 1. Similarly, the [right side] components on the other sidle are connected to be slidable together along the rotary axis of main shaft 1. A holding means 90, discussed below, is provided to control when [the] roller holder means [8] 8*a* and 8*b* and divided rollers [7] 7*a* and 7*b* are slidable along main shaft 1. When [the] holding means 90 is in an engaged position [the] roller holder means [8] 8*a* and 8*b* and divided rollers [7] 7*a* and 7*b* are fixed; and when [the] holding means 90 is in a disengaged position they are movable. The details of roller holder means [8] 8*a* and 8*b* are discussed below.

To slide roller holder means [8] 8*a* and 8*b* and divided rollers [7] 7*a* and 7*b* along main shaft 1, [the] holding means 90 is in the disengaged position and rotatable handle 6 is rotated. Due to the direction of the screw threads on ends 3*a* and 3*b* of adjusting shaft 3, when rotatable handle 6 is rotated in one direction, [left and right] roller holder means [8,] 8*a* and 8*b*, divided rollers [7,] 7*a* and 7*b*, transmitting rods [9,] 9*a* and 9*b*, flanges [5] 5*a* and 5*b* and screw members [4] 4*a* and 4*b* move apart from each other as two separate units in first and second expanding directions of movement which are opposite to each other thereby increasing the interval between divided rollers [7] 7*a* and 7*b*. Whereas, when [the] rotatable handle 6 is rotated in the opposite direction the interval between divided rollers [7 is decreased. Once the] 7*a* and 7*b* is decreased because roller holder means 8*a* and 8*b*, divided rollers 7*a* and 7*b*, transmitting rods 9*a* and 9*b*, flanges 5*a* and 5*b* and screw members 4*a* and 4*b* move toward each other as two separate units in first and second contracting directions of movement which are opposite to each other. Once rollers holder means [8] 8*a* and 8*b* and divided rollers [7] 7*a* and 7*b* are in a desired position, [the] holding means 40 is engaged to slidably fix [the] roller holder means [8] 8*a* and 8*b* and divided rollers [7] 7*a* and 7*b* in that position.

Figure 2:
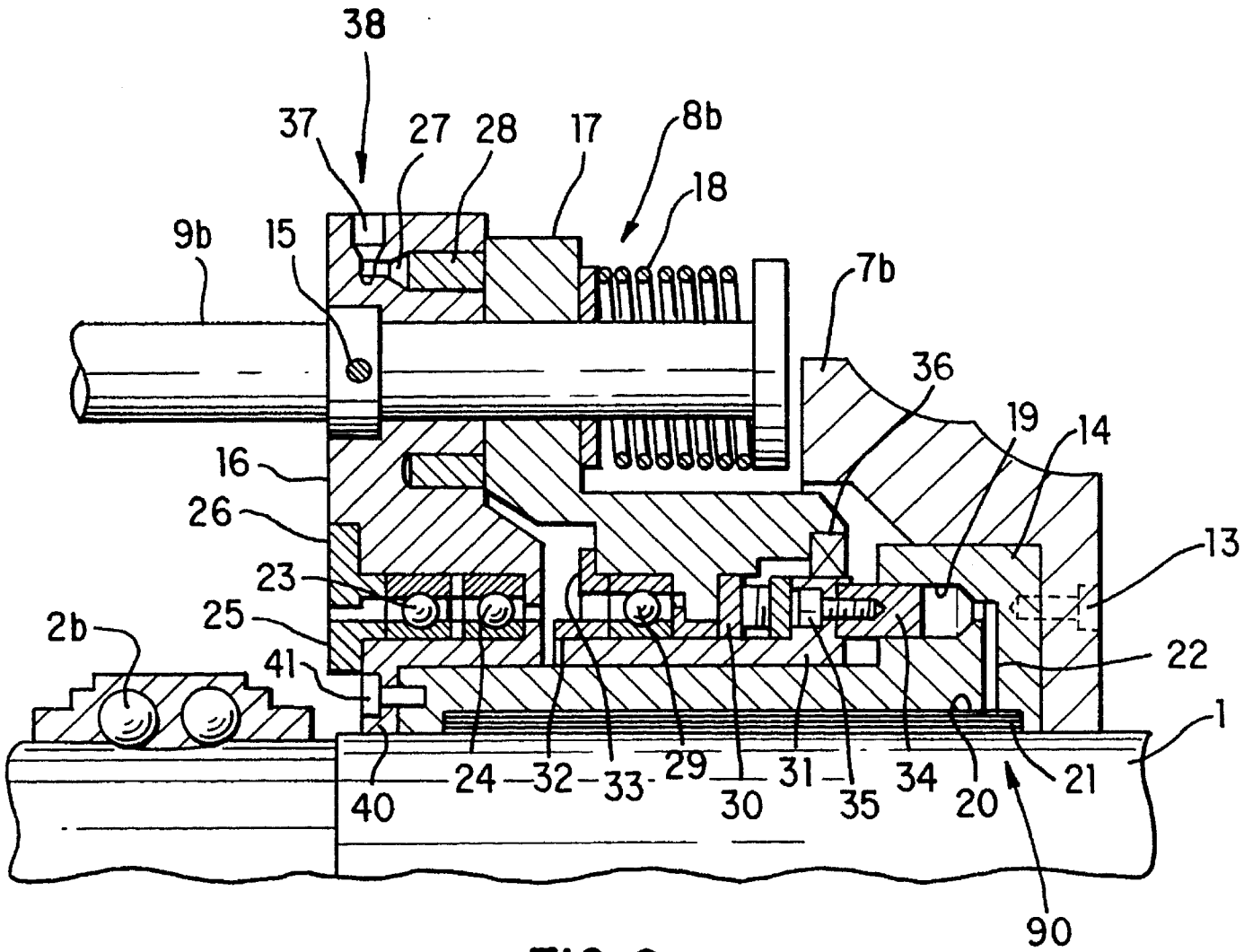
FIG. 2 is an enlarged cross sectional view of a portion of the invention of FIG. 1 taken along line 2—2 in FIG. 1.

Referring now to FIG. 2, an enlarged sectional view of a portion of the roller width adjuster device shown in FIG. 1, will be discussed in detail. In the embodiment shown and discussed below, although each roller holder means [8] 8*a* and 8*b* is slidable along [mainshaft] main shaft 1, each roller holder means [8] 8*a* and 8*b* is rotatable independent from main shaft 1. In other words, each roller holder means [8] 8*a* and 8*b* does not rotate together with main shaft 1. This feature will be illustrated below.

Roller holder means [8] 8*b* comprises a first metallic holder 16, a second metallic holder 17, a spring 18 and an auxiliary piston 28. First metallic holder 16 is fixed to transmitting rod [9] 9*b* through a pin 15 and is freely fitted onto an outer periphery of hollow peripheral cylinder 40 through bearings 23 and 24. Peripheral cylinder 40 is fixed to a hollow hydraulic [cylinder] holder 14 (discussed below) by a bolt 41. Thus, hydraulic holder 14 and peripheral cylinder [41] 40 are rotatable as a unit with respect to first metallic holder 16 through bearings 23 and 24. Bearings 23 and 24 are fixed by an inner ring holder 25 and an outer ring holder 26, respectively.

Second metallic holder 17 is provided adjacent to first metallic holder 16. Transmitting rod [9] 9*b* passes through first metallic holder 16 and second metallic holder 17. Spring 18 disposed on an end of transmitting rod [9] 9*b* is for biasing second metallic holder 17 toward first metallic holder 16. Auxiliary piston 28 (discussed below) is fitted into a ring-like-shaped hydraulic chamber 27 provided in first metallic holder 16.

On a same side of divided type molding roller [7] 7*b* that the driving device (not shown) is disposed, divided type molding roller [7] 7*b* is connected to hydraulic holder 14 by bolt 13. A holding member 31 is fixed to hydraulic holder 14 by a main piston 34. Main piston 34 has a first end disposed in a t) cylindrical chamber 19 in hydraulic holder 14 and a second end connected to holding member 31 by a bolt 35. Main piston 34 is slidable in parallel to the rotary axis of main shaft 1. Main piston 34 is slidable between one position where fluid is retained, substantially, in cylindrical chamber 19; and another position where the fluid is forced out of cylindrical chamber 19 into hydraulic chamber 20. Holding member 31 rotates together with hydraulic holder 14, but is laterally slidable on a periphery of hydraulic holder 14. Specifically, hydraulic holder 14 is laterally slidable in parallel spaced relationship with the rotary axis of main shaft 1.

Hydraulic holder 14 is disposed over main shaft 1 and includes an inner peripheral surface that is disposed adjacent to the outer periphery of main shaft 1. Hydraulic holder 14 includes four hydraulic cylinder chambers 19 and pistons 34. The four hydraulic cylinder chambers 19 are disposed circumferentially in hydraulic holder 14 such that each of the four hydraulic cylinder chambers 19 is symmetrically disposed relative to each other.

[A] Holding means 90 includes pair of hydraulic chambers 20 [are] bored on the inner peripheral surface of hydraulic [cylinder] holder 14 so as to be diametrically opposed to each other. Bored hydraulic chambers 20 extend in a direction parallel to the rotary axis of main shaft 1. A cylindrical thin film 21 is joined to hydraulic chamber 20 by welding or another equivalent means. This construction forms a hydraulic clutch. When thin film 21 is under pressure from oil that passes through a hydraulic passage 22 in hydraulic holder 14, thin film 21 expands in a direction toward the outer periphery of main shaft 1. The details of how the oil flow is controlled is discussed below. As a result, the hydraulic clutch is engaged, whereby hydraulic holder 14 (and connected parts such as divided roller [7)] 7*b*) and main shaft 1 are held together to form an integrated unit. In particular, when the hydraulic clutch is engaged, the diameter of hollow hydraulic holder 14 is effectively reduced by the expansion of thin film 21 under pressure from the oil. Thereby contact is made between the inner peripheral surface of hydraulic holder 14 and the outer periphery of main shaft 1. Accordingly, hydraulic holder 14 and its connected parts, in particular, divided roller [7] 7*b*, rotate together with main shaft 1. However, hydraulic holder 14 and therefore this integrated unit, are rotatable with respect to first holder 16 and therefore roller holder means [8] 8*b*, through bearings 23 and 24.

In contrast, when oil pressure is reduced, the inner peripheral surface of hydraulic holder 14 and the outer periphery of main shaft 1 cease being in contact. Since the hydraulic clutch is disengaged, main shaft 1 rotates independent from hydraulic holder 14 and divided roller [7] 7*b*. When the hydraulic clutch is disengaged, [the] roller holder means [8] 8*a* and 8*b* and divided rollers [7] 7*a* and 7*b* can be adjusted or slide axially by the use of rotatable handle 6 (see below).

First metallic holder 16 is axially symmetrically provided with a ring-like-shaped hydraulic chamber 27. Second metallic holder 17 abuts against an auxiliary piston 28 fitted in hydraulic chamber 27. Auxiliary piston 28 moves in a direction parallel to the longitudinal axis of the main shaft 1 and between an extended and a retracted position. Second metallic holder 17 is rotatable by way of a bearing 29 and thrust bearing 30 on an outer periphery of holding member 31. In addition, an inner ring side of bearing 29 is fixed to holding member 31 through a nut 32. An outer ring side of bearing 29 is fixed to an outer ring holder 33 and second holder 17. The holding member 31 is connected by bolt 35 to main piston 34 fitted into the hydraulic chamber 19. An oil seal 36 is interposed between second holder 17 and holding member 31.

To engage the hydraulic clutch means after rotating handle 6 has been rotated to position roller holder [8] means 8*b*, pressurized oil is supplied (shown generally as arrow 38) to hydraulic chamber 27 through a port 37 bored in first holder 16. As a result, auxiliary piston 28 slides axially under pressure causing second holder 17 to move. As a result of the movement of second holder 17, main piston 34 is put under pressure causing main piston 34 to move in an axial direction. With this movement of main piston 34, oil in hydraulic cylinder chamber 19 is loaded into cylindrical thin film 21 through a pressure oil passage 22. By loading oil into hydraulic chamber 20, which has cylindrical thin film 21, the hydraulic clutch is engaged as discussed above. When the hydraulic clutch is engaged roller holder means [8] 8*b* and divided type molding roller [7] 7*b* are slidably fixed. In addition, divided type molding roller [7] 7*b* rotates together with main shaft 1. Yet, rotating handle 6, transmitting rods [9] 9*b* (and attachments) and roller holder means [8] 8*b* do not rotate within main shaft 1 and instead remain stationary relative to main shaft 1.

To eliminate contact between divided type molding roller [7] 7*b* and main shaft 1 so that divided type molding roller [7] 7*b* does not rotate together with main shaft 1 the hydraulic clutch means must be disengaged. To disengage the hydraulic clutch, the pressurized oil is discharged from port 37 so that the auxiliary piston 28 is restored to its original position by a biasing force of spring 18. When the hydraulic clutch is disengaged, [the] roller holder means [8] 8*b* and divided type molding roller [7] 7*b* are axially slidable by rotating rotatable handle 6. In other words, divided type molding roller [7] 7*b* is no longer contacting main shaft 1 and does not rotate with main shaft 1.

In the present invention, adjustable shaft 3 is disposed in hollow main shaft 1 and is provided with screw [member 4] members 4*a* and 4*b* and rotating handle 6. Roller holder means [8] 8*b* is positionable on the outer periphery of the main shaft in a plurality of positions via engagement/disengagement of the hydraulic clutch. The hydraulic clutch is controlled by pressurization of the two stage piston mechanism comprising main piston 34 and [auxiliary] auxiliary. piston 28. Therefore, with the present invention, by rotating adjustable shaft 3 to move roller holder means [8] 8*b*, divided type molding roller [7] 7*b* can quickly be positioned. Hence, the time to replace the roller is reduced. Also, the quality of pipe produced is improved due to improvements in the accuracy of setting the roller width with the present invention. Furthermore, less labor is required and work safety is improved.

Moreover, since a conventional rotary joint is not used, there is no problem with the life-span of the oil seal. Thus, the present invention is suitable for high speed pipe manufacturing.

While a preferred embodiment of the invention has been described using specific terms, such description is for illustrative purposes only, and it is to be understood that changes and variations may be made without departing from the spirit or scope of the following claims.

What is claimed is:

1. A roller width adjusting device for a divided type molding roller, comprising:

a hollow main shaft having a first end and a second end, an interior area, an outer periphery and a rotary axis;

a first side bearing journalled to said first end of said hollow main shaft;

a second side bearing journalled to said second end of said hollow shaft;

a gear disposed at said first end of said hollow main shaft for being connected to a drive source for driving said hollow main shaft;

a first hollow cylindrical roller holder axially slidably disposed on said outer periphery of said first end of said hollow main shaft;

a second hollow cylindrical roller holder axially slidably disposed on said outer periphery of said second end of said hollow main shaft;

a first divided type molding roller connected to said first roller holder;

a second divided type molding roller connected to said second roller holder, wherein said first and second divided type molding rollers are disposed with an interval therebetween;

holding means for fixing said first and second roller holders at a plurality of axial positions along said outer periphery of said main shaft;

an adjusting shaft rotatably disposed in said interior area of said main shaft and having a first adjusting shaft end and a second adjusting shaft end, wherein said first adjusting shaft end has a screw thread in a first direction and said second adjusting shaft end has a screw thread in a second direction different from said first direction and a rotatable handle disposed on one of said first and second adjusting shaft ends;

a first screw movable on said screw thread in said first direction in a first expanding direction of movement and a first contracting direction of movement, wherein said first screw transmits said first expanding direction of movement and said first contracting direction of movement to said first roller holder;

a second screw moveable on said screw thread in said second direction in a second expanding direction of movement opposite to said first expanding direction of movement and a second contracting direction of movement opposite to said first contracting direction of movement, wherein said second screw transmits said second expanding direction of movement and said second contracting direction of movement to said second roller holder, wherein said rotatable handle controls said movement of said first and second screws and thereby said first and second roller holders, wherein said rotatable handle is rotatable in one direction thereby causing said first and second screws to move in said first and second expanding directions of movement and in another direction thereby causing said first and second screw to move in said first and second contracting directions of movement.

2. A roller width adjusting device for a divided, type molding roller as set forth in claim 1, wherein said holding means has an engaged position and a disengaged position, whereby when said holding means is in said engaged position said hollow main shaft rotates with said first and second divided rollers and said first and second roller holders are slidably and rotatably fixed relative to said hollow main shaft, and whereby when said holding means is in said disengaged position said first and second roller holders and said first and second divided roller holders are slidable along said rotary axis of said main shaft.

3. A roller width adjusting device according to claim 2, wherein said holding means comprises a two-stage piston mechanism including a main piston and an auxiliary piston for controlling engagement and disengagement of said holding means by controlling fluid pressure to said holding means.

4. A roller, width adjusting device according to claim 2, wherein said first and second roller holder further comprise:

a first holder fixed by a transmitting rod and a flange to said first screw and including a hydraulic chamber having an opening on a side of said first holder; and a second holder adjacent said side of said first holder and biased toward said first holder by a spring, wherein an auxiliary piston is disposed in said hydraulic chamber and is slidable between a retracted and a projected position parallel to said rotary axis of said hollow main shaft, whereby projection of said auxiliary piston shifts said second holder.

5. A roller width adjusting device according to claim 4, further comprising:

a hydraulic holder slidably disposed on said main hollow shaft along said rotary axis and fixed to said divided roller, wherein said hydraulic holder has an inner periphery adjacent an outer periphery of said hollow main shaft and said holding means comprises a chamber bored on said inner periphery and parallel to said rotary axis and a thin film disposed over said bored chamber;

a second hydraulic chamber disposed in said hydraulic holder in fluid communication with said bored chamber and having a main piston disposed therein that is slidable between a fluid retaining and a fluid forcing position, wherein disposition of said auxiliary piston in said projected position causes said main piston to slide toward said fluid forcing position, thereby forcing fluid to flow into said bored chamber, which causes said hollow main shaft to be rotatably fixed with said hydraulic holder and said divided roller.

* * * * *

UNITED STATES PATENT AND TRADEMARK OFFICE

CERTIFICATE OF CORRECTION

PATENT NO. : 5,599,264

DATED : February 4, 1997

INVENTORS : Hashimoto *et al.*

It is certified that an error appears in the above-identified patent and that said Letters Patent is hereby corrected as shown below.

Page 1, column 1, under "U.S. Patent Documents", delete "36,237" and substitute --36,257-- therefor, also delete "2,178,754" and substitute --2,148,754 therefor.

Signed and Sealed this

Twentieth Day of May, 1997

*Attest:*

Bruce Lehman

BRUCE LEHMAN

*Attesting Officer*

*Commissioner of Patents and Trademarks*